US010267487B2

(12) United States Patent
De Bevilacqua et al.

(10) Patent No.: US 10,267,487 B2
(45) Date of Patent: Apr. 23, 2019

(54) LIGHTING DEVICE

(71) Applicant: ARTEMIDE S.p.A., Milan (IT)

(72) Inventors: Carlotta Francesca Isolina Maria De Bevilacqua, Milan (IT); Roberto Efrem Franzosi, Milan (IT)

(73) Assignee: ARTEMIDE S.P.A. (IT)

( * ) Notice: Subject to any disclaimer, the term of this patent is extended or adjusted under 35 U.S.C. 154(b) by 0 days.

(21) Appl. No.: 15/468,287

(22) Filed: Mar. 24, 2017

(65) Prior Publication Data

US 2017/0276321 A1 Sep. 28, 2017

(30) Foreign Application Priority Data

Mar. 25, 2016 (IT) ..... 102016000031730

(51) Int. Cl.

| | |
|---|---|
| ***F21V 7/04*** | (2006.01) |
| ***F21V 7/22*** | (2018.01) |
| ***F21V 11/00*** | (2015.01) |
| ***F21Y 115/10*** | (2016.01) |
| ***F21V 19/00*** | (2006.01) |

(52) U.S. Cl.

CPC ..... *F21V 7/04* (2013.01); *F21V 7/048* (2013.01); *F21V 7/22* (2013.01); *F21V 11/00* (2013.01); *F21V 19/003* (2013.01); *F21Y 2115/10* (2016.08)

(58) Field of Classification Search

CPC ..... F21V 7/04; F21V 7/048; F21V 11/00
USPC ..... 362/348, 343, 350, 351, 344
See application file for complete search history.

(56) References Cited

U.S. PATENT DOCUMENTS

| | | | | |
|---|---|---|---|---|
| 5,272,408 | A * | 12/1993 | Levin | F21V 7/09 313/113 |
| 7,862,213 | B2 * | 1/2011 | Gordin | F21V 7/09 362/247 |
| 9,920,892 | B2 * | 3/2018 | Yurich | F21S 2/005 |
| 10,006,590 | B2 * | 6/2018 | Koizumi | F21K 9/232 |
| 2006/0044808 | A1 * | 3/2006 | Gorres | F21V 7/048 362/341 |
| 2006/0083006 | A1 * | 4/2006 | Poel | F21V 7/09 362/346 |
| 2006/0193135 | A1 | 8/2006 | Hein | |
| 2009/0034272 | A1 * | 2/2009 | Gorres | F21V 7/04 362/346 |

FOREIGN PATENT DOCUMENTS

| | | |
|---|---|---|
| CN | 204042762 | 12/2014 |
| CN | 204042763 | 12/2014 |

(Continued)

OTHER PUBLICATIONS

Machine translation of "Du et al.", CN 204042763U, published Dec. 24, 2014.*

(Continued)

*Primary Examiner* — William N Harris
(74) *Attorney, Agent, or Firm* — The Belles Group, P.C.

(57) ABSTRACT

A lighting device, in particular a LED lighting device, comprises at least one light source and a reflector extending along and around a longitudinal axis and having an internal reflective surface arranged so as to intercept at least part of the light emitted by the light source and reflect said part towards a light exit opening; the internal reflective surface is a faceted polynomial surface.

18 Claims, 3 Drawing Sheets

(56) References Cited

FOREIGN PATENT DOCUMENTS

| | | |
|---|---|---|
| EP | 2330340 | 6/2011 |
| GB | 2505214 | 2/2014 |
| WO | 9217733 | 10/1992 |
| WO | 2008140884 | 11/2008 |
| WO | 2014139183 | 9/2014 |

OTHER PUBLICATIONS

Corresponding Italian Search Report for ITUA20162048 dated Sep. 2, 2016.

* cited by examiner

LIGHTING DEVICE

PRIORITY CLAIM

This application claims priority from Italian Patent Application No. 102016000031730 filed on Mar. 25, 2016, the disclosure of which is incorporated by reference.

TECHNICAL FIELD

The invention relates to a lighting device, in particular a LED lighting device, which is suitable to be used as a light projector for the illumination of objects and/or rooms.

BACKGROUND OF THE INVENTION

In the lighting field and, in particular, in the field of light projectors (lighting apparatuses that, by means of optical elements such as mirrors or lenses, project an intense light beam with a great capacity, which is emitted by a light source, so as to light objects and/or rooms), parabolic reflectors are largely used, namely reflectors having a parabolic cross section and obtained from a parabolic profile which, by rotating around its axis, generates a paraboloid of revolution.

By placing a light source in the focus of the rotation solid obtained by so doing (parabolic reflector), a light projector with an extremely narrow and basically collimated beam is obtained.

To change the amplitude of the light beam emitted, thus obtaining light beams with larger emission angles, which is often requested by users, it is known to provide the inner surface of the parabolic reflector with curved (convex) facets arranged in a radial manner. Depending on the bending radius of the facets, beams with different amplitudes are obtained.

Projectors of the type described above are affected by at least two main drawbacks:

- the beam emitted by the projector is influenced by the parabolic profile and usually has an excessive axial intensity;
- the facets arranged in a radial manner, in order to distribute the light far from the axis and, hence, widen the light beam emitted, must have a very marked curvature (short bending radius), but, in this way, the light reflected by the facets can be redirected into the reflector (instead of being projected outwards), thus causing secondary reflection that can cause dazzling and reduce the optical efficiency.

Furthermore, if the projector uses a LED light source, which is becoming more and more common, you can typically experience the projection of undesired light rings onto a working surface lit by the projector.

White light LEDs, then, emit light beams that are usually subjected to a colour temperature variation as the distance from the symmetry axis of the LED increases. As a consequence, the further drawback can arise consisting in the projection of yellowish areas (spots) on a white background.

Finally, it should be taken into account the fact that commonly used reflective surfaces normally are mirror-polished and have irregularities due to the production process and, in particular, to the techniques used to obtain the polished finish. These irregularities, which usually do not jeopardize optical performances, can though create an undesired effect, making the reflector "bright" (lit up).

SUMMARY OF THE INVENTION

The object of the invention is to provide a lighting device, which can overcome the drawbacks described above, which affect prior art devices.

Therefore, the invention relates to a light device according to appended claim 1.

Further preferred features of the invention are described in the dependent claims.

The lighting device according to the invention leads to the following main results:

- high efficiency, as all the light rays emitted by the source leave the lighting device after one single reflection, hence without losses of efficiency;
- high lighting uniformity;
- full control of the emission, in particular in terms of amplitude of the emitted beam;
- complete elimination of possible light defects generated, in particular, by the use of LED light sources.

BRIEF DESCRIPTION OF THE DRAWINGS

Further features and advantages of the invention will be best understood upon perusal of the following description of a non-limiting embodiment thereof, with reference to the accompanying drawings, wherein.

DETAILED DESCRIPTION OF THE INVENTION

Figure 1:
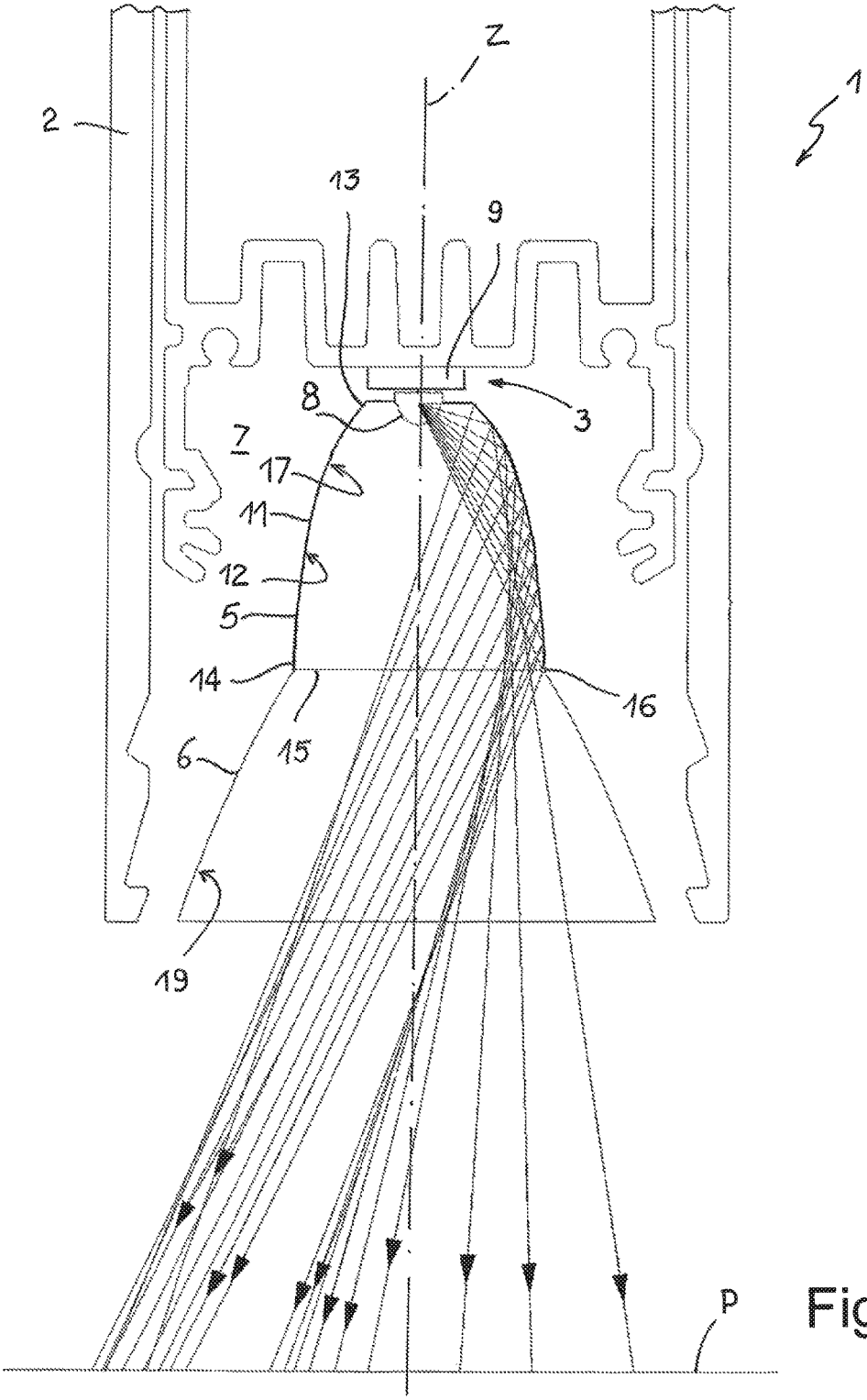
FIG. 1 is a schematic view showing a longitudinal section of a lighting device according to the invention.

In FIG. 1, number 1 indicates, as a whole, a lighting device (light projector), in particular a LED lighting device, for the illumination of objects and/or rooms, for example to light a working surface P.

The device 1 comprises a support structure 2, at least one light source 3, a reflector 5 and, optionally, a shield 6.

The support structure 2, which is only schematically and partially shown in FIG. 1, can have different shapes, also based on the purpose of the device (which can be used as a suspension lamp, a floor lamp, etcetera). In the non-limiting example shown herein, the support structure 2 is longitudinally elongated and bar-shaped, and has an inner compartment 7, which houses the light source 3, the reflector 5 and possibly the shield 6.

The light source 3 is, in particular, a LED light source comprising one or more LEDs 8 carried by a support 9.

The reflector 5 extends along and around a longitudinal axis Z, which also defines an optical axis of the device 1, and has a generically cup-shaped hollow body 11, which is longitudinally elongated along the axis Z and delimits an inner cavity 12, where the light source 3 is located. The body 11 and the entire reflector 5 extend between a proximal end 13, where the light source 3 is located, and a distal end 14, which is provided with a light exit opening 15, which is delimited by a peripheral edge 16.

The light source 3 is placed along the axis Z at the proximal end 13 of the reflector 5.

The reflector 5 has an internal reflective surface 17, which faces the cavity 12 and is a faceted polynomial surface, as described more in detail below.

The (optional) shield 6 projects from the distal end 14 of the reflector 5 and is joined to the edge 16.

The shield 6 has a flared shape along the axis Z and widens from the edge 16 towards the outside of the device 1. For example, the shield 6 has a substantially square base truncated-pyramid shape, if necessary with slightly curved lateral walls; it remains understood that the shield 6 can also have other shapes.

In general, the shield 6 has diverging and preferably concave inner lateral walls 19.

Figure 2:
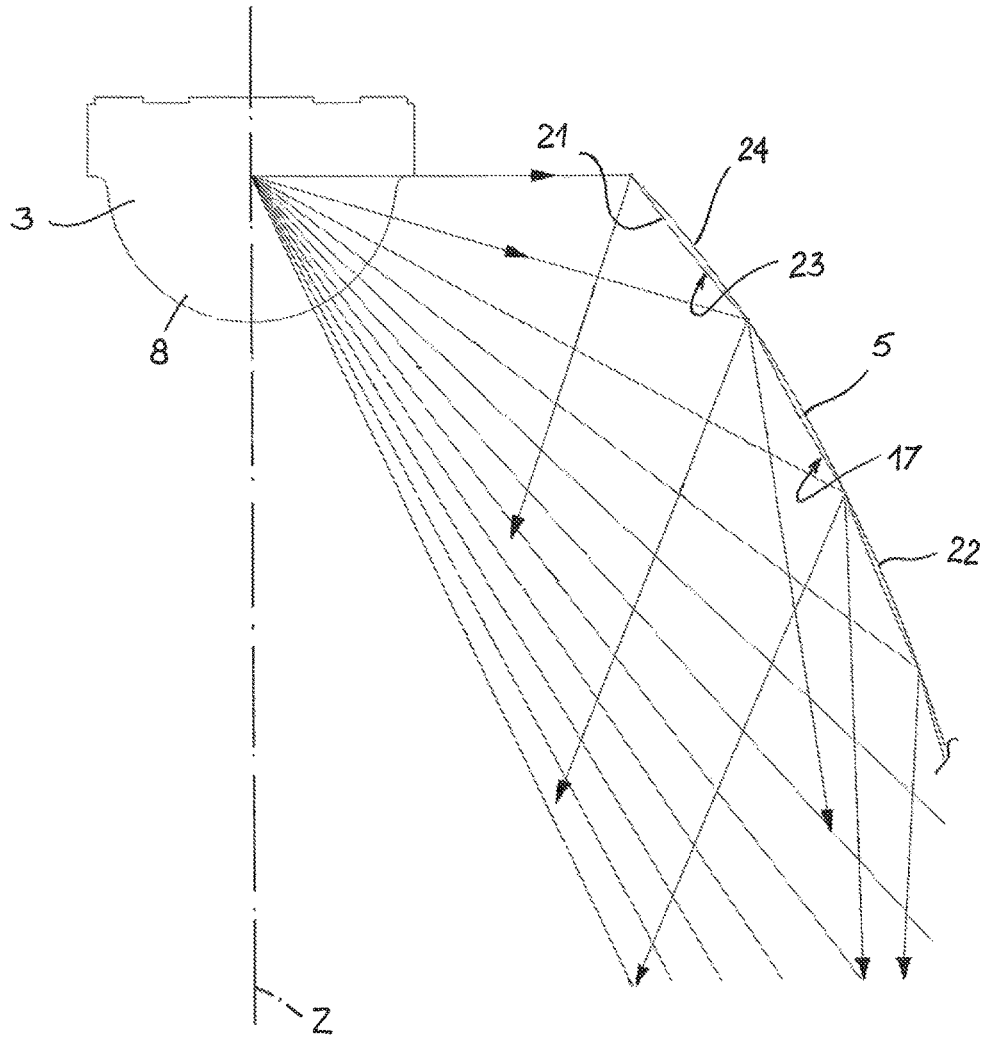
FIG. 2 is a view, on a larger scale, of a detail of the device of FIG. 1.
Figure 3:
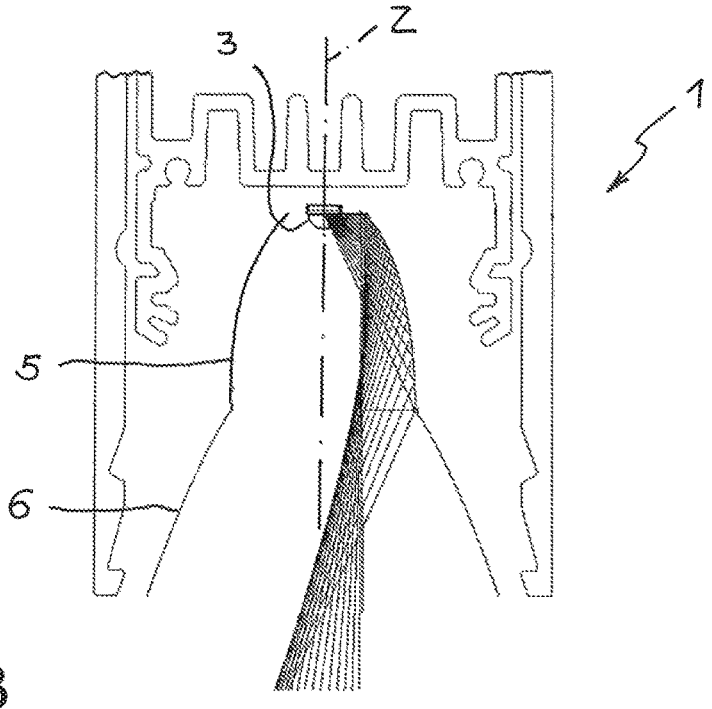
FIGS. 3 and 4 are further schematic views, on different scales and with parts removed for greater clarity, of the lighting device of FIG. 1.
Figure 4:
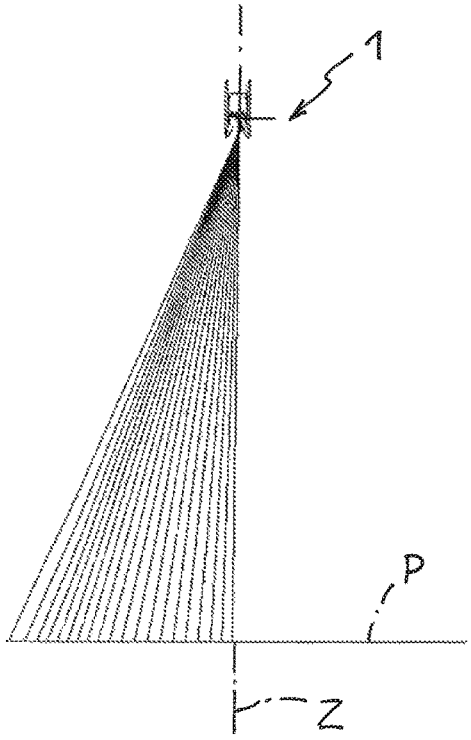

With reference also to FIGS. 2-4, the surface 17 is formed by a pattern of reflective sectors 21 or facets arranged on a polynomial base surface 22 (therefore, the base surface 22 is a virtual surface and does not coincide with the actual reflective surface 17 of the reflector 5).

For example, in a reference Cartesian system X, Y, Z, wherein Z is the longitudinal axis of the device 1 and the axes X, Y are two axes that are orthogonal to one another and to the axis Z, the base surface 22 is defined by a function of the following type:

$$z = \frac{c * r^2}{1 + \sqrt{(1 - s * c^2 * r^2)}} + a_2 * r^2 + a_4 * r^4 + \ldots + a_n * r^n \quad \text{(I)}$$

wherein:

c is the curvature of the surface s is a parameter defining the starting conic type $r=\sqrt{x^2+y^2}$ $a_2, a_4, \ldots, a_n$ are coefficients of the polynomial The sectors 21 (facets) make up the faceting of the base surface 22 and are arranged adjacent to one another on the base surface 22.

In a preferred embodiment, the sectors 21 are arranged on crowns which are circular around the axis Z and which follow one another longitudinally, each crown being formed by a plurality of equal sectors 21 arranged side-by-side. Sectors 21 arranged on longitudinally successive crowns can have different shapes and/or different bending radii.

Each sector 21 has a reflective surface 23, which faces the cavity and is curved, precisely convex, for example with the shape of a spherical cap.

In general, the reflective surfaces 23 of the sectors are surfaces with a wide radius, namely they have a relatively great bending radius and, therefore, a not very marked curvature.

Preferably, the reflective surfaces 23 are mirror-polished surfaces.

The polynomial base surface 22 (i.e. the ideal or virtual surface on which the sectors 21 are located) is designed so as to reflect the light emitted by the light source 3 in a beam having a predetermined amplitude (angle).

In other words, the base surface 22 (which is to be understood as an ideal smooth surface, hence a non-faceted one, without the sectors 21) has a shape that is such as to reflect the light emitted by the light source 3 through the light exit opening 15 in a beam that has a predetermined emission angle.

Therefore, the desired beam amplitude or emission angle of the device 1 (namely, the angle of emission of the beam coming out of the device 1) is obtained by properly designing the base surface 22.

However, according to the invention, the internal reflective surface 17 of the reflector is not smooth and does not consist of the base surface 22, but it is faceted and formed by the pattern of sectors 21.

By so doing, possible irregularities of the surface 17, which are usually present, are prevented from determining lighting defects, which, for example, cause the reflector 5 to be "bright" (lit up) and visible (while, ideally, it should be appears free from illumination).

As a matter of fact, due to constructive reasons, any actual reflective surface, in particular mirror-polished surfaces (anyway produced, for example obtained by means of polishing of a layer of aluminium or through vacuum aluminium deposition, but also with any other production technology), has irregularities resulting from the productive process and, in particular from the process carried out to obtain the polished finish.

Each sector 21 covers a virtual portion 24 of the base surface 22; each portion 24 subtends the reflective surface 23 of a sector 21.

The reflective surfaces 23 of the sectors 21 are shaped so as to reflect the incident light (coming from the light source 3) directly through the light exit opening 15, and so as not to impinge again, after the first reflection, neither the reflector 5 nor, if present, the shield 6.

In particular, the reflective surface 23 of each sector 21 is shaped so as to increase the divergence of the reflected beam with respect to the reflection that would occur on the portion 24 of the base surface 22 subtending the same sector 21. In other words, if a portion 24 of the base surface 22 is shaped so as to reflect the incident light (coming from the light source 3) in a beam with amplitude a, the reflective surface 23 of the sector 21 covering the same portion 24 is shaped so as to deflect said beam, thus generating a reflected beam with amplitude $\alpha+\beta$ (which, anyway, is such as not to further hit the reflector 5 or, if present, the shield 6).

In use, the light source 3 emits light rays (not shown) which directly leave the light exit opening 15 without hitting the reflector 5, as well as light rays (shown in the figures) which, on the other hand, hit the reflector 5 and are reflected by the surface 17 and, precisely, by the reflective surfaces 23 of the sectors 21.

The reflector 5 reflects the light rays emitted by the light source 3 in a uniform manner onto a reference plane perpendicular to the axis Z (working surface to be lit by the device 1) and within the predetermined emission angle.

Therefore, the device 1 emits a light beam having a predetermined angle and with a high lighting uniformity.

Furthermore, besides the possible lack of uniformity, also imperfections (spots) of the light beam emitted by the device 1 are eliminated.

As the reflective surfaces 23 of the sectors 21 are designed so that the light rays, after a first reflection inside the reflector 5 on the reflective surfaces 23, do not hit again the reflector 5, but are directly emitted outwards towards the light exit opening 15, there is no reduction of the efficiency due to double or multiple reflections or to dazzling caused by them.

Furthermore, in order to have a complete darkening also beyond the predetermined angle of emission, the device 1 can be provided with the shield 6.

It is finally remarked that the lighting device described and explained herein can be subjected to changes and variants, which do not go beyond the scope of protection set forth in the appended claims.

The invention claimed is:

1. A lighting device comprising:

a light source;

a reflector extending along and around a longitudinal axis, the reflector having an internal reflective surface arranged so as to intercept at least part of a light emitted by the light source and reflect said part towards a light exit opening;

a shield projecting from a distal end of the reflector, the distal end of the reflector being opposite to a proximal end of the reflector where the light source is located, wherein the shield is joined to a peripheral edge of the reflector that delimits the light exit opening;

wherein said internal reflective surface is a faceted polynomial surface comprising a pattern of reflective sectors arranged adjacent to one another on a polynomial base surface and having respective reflective surfaces;

wherein said reflective surfaces of said reflective sectors are convex surfaces;

wherein each reflective sector covers a virtual portion of the polynomial base surface that subtends the reflective surface of the reflective sector;

wherein the reflective surface of each reflective sector is shaped so as to increase a divergence of the reflected part of the light emitted by the light source with respect to a reflection that would occur on the virtual portion of the polynomial base surface subtending the reflective sector; and wherein each virtual portion of the polynomial base surface is shaped so as to reflect the light emitted by the light source in a beam with a first amplitude $\alpha$, the reflective surface of the reflective sector covering the virtual portion being shaped so as to deflect said beam and generate a reflected beam with a larger amplitude $\alpha+\beta$ so as not to further impinge the reflector or the shield.

2. A lighting device according to claim 1, wherein the reflective surfaces of the reflective sectors are mirror-polished surfaces.

3. A lighting device according to claim 1, wherein the light source is a LED light source comprising one or more LEDs.

4. A lighting device according to claim 1, wherein the shield has a flared shape along the longitudinal axis and widens from the peripheral edge towards an outside of the lighting device.

5. A lighting device according to claim 1, wherein the shield has a truncated-pyramid shape.

6. A lighting device according to claim 1, wherein the shield has diverging and concave inner lateral walls.

7. A lighting device according to claim 1 wherein the reflector defines a cavity and wherein the reflective surfaces of said reflective sectors face the cavity.

8. A lighting device according to claim 7 wherein the reflective surfaces of each of the reflective sectors has a shape of a spherical cap.

9. The lighting device according to claim 1 wherein the reflective sectors are arranged in crowns that circumferentially surround the longitudinal axis and which follow one another longitudinally, each crown being formed by a plurality of equal sectors arranged side-by-side.

10. The lighting device according to claim 9 wherein the reflective sectors arranged on longitudinally successive crowns have different shapes and/or different bending radii.

11. A lighting device comprising:

a light source that emits a light;

a reflector extending from a proximal end to a distal end along a longitudinal axis and defining a cavity having a light exit opening at the distal end, the reflector comprising:

a polynomial base surface having a concave inner surface that faces the cavity; and a pattern of facets protruding from the concave inner surface of the polynomial base surface, each of the facets having a convex reflective surface that faces the cavity, the convex reflective surfaces of the facets collectively forming an internal reflective surface that faces the cavity;

a shield projecting from the distal end of the reflector, wherein the shield is joined to a peripheral edge of the reflector that delimits the light exit opening; and wherein at least a portion of the light that is emitted from the light source contacts the internal reflective surface, and wherein the internal reflective surface is shaped so that the portion of the light that contacts the internal reflective surface is reflected directly through the light exit opening without contacting the internal reflective surface a second time and without contacting the shield.

12. A lighting device according to claim 11 wherein the convex reflective surfaces of each of the facets has a spherical cap shape.

13. A lighting device comprising:

a light source;

a reflector extending along and around a longitudinal axis, the reflector having an internal reflective surface arranged so as to intercept at least part of a light emitted by the light source and reflect said part towards a light exit opening;

a shield projecting from a distal end of the reflector, wherein the shield is joined to a peripheral edge of the reflector that delimits the light exit opening;

wherein said internal reflective surface is a faceted polynomial surface comprising a pattern of reflective sectors arranged adjacent to one another on a polynomial base surface and having respective reflective surfaces;

wherein said reflective surfaces of said reflective sectors are convex surfaces having a spherical cap shape; and wherein the reflective surfaces of the reflective sectors are shaped so that the part of the light that is intercepted by the internal reflective surface is reflected directly through the light exit opening without contacting the internal reflective surface a second time and without contacting the shield.

14. A lighting device according to claim 11 wherein the shield has a truncated-pyramid shape.

15. A lighting device according to claim 11 wherein the shield has diverging and concave inner lateral walls.

16. A lighting device according to claim 11 wherein the internal reflective surface comprises a pattern of reflective sectors, wherein the reflective sectors are arranged in crowns that circumferentially surround the longitudinal axis and which follow one another longitudinally, each crown being formed by a plurality of equal sectors arranged side-by-side.

17. A lighting device according to claim 13, wherein the shield has diverging and concave inner lateral walls.

18. A lighting device according to claim 13 wherein the reflective sectors are arranged in crowns that circumferentially surround the longitudinal axis and which follow one another longitudinally, each crown being formed by a plurality of equal sectors arranged side-by-side.

* * * * *